US009926773B2

(12) United States Patent
Hallundbæk et al.

(10) Patent No.: US 9,926,773 B2
(45) Date of Patent: Mar. 27, 2018

(54) EXPANDABLE DROP DEVICE

(71) Applicant: WELLTEC A/S, Allerød (DK)

(72) Inventors: Jørgen Hallundbæk, Græsted (DK); Christian Krüger, Holte (DK)

(73) Assignee: WELLTEC A/S, Allerød (DK)

( * ) Notice: Subject to any disclaimer, the term of this patent is extended or adjusted under 35 U.S.C. 154(b) by 323 days.

(21) Appl. No.: 14/425,477

(22) PCT Filed: Sep. 13, 2013

(86) PCT No.: PCT/EP2013/069010
§ 371 (c)(1),
(2) Date: Mar. 3, 2015

(87) PCT Pub. No.: WO2014/041123
PCT Pub. Date: Mar. 20, 2014

(65) Prior Publication Data

US 2015/0218923 A1 Aug. 6, 2015

(30) Foreign Application Priority Data

Sep. 14, 2012 (EP) ..... 12184463

(51) Int. Cl.
*E21B 34/14* (2006.01)
*E21B 43/25* (2006.01)
(Continued)

(52) U.S. Cl.
CPC ..... *E21B 43/25* (2013.01); *E21B 33/124* (2013.01); *E21B 33/1275* (2013.01);
(Continued)

(58) Field of Classification Search
None
See application file for complete search history.

(56) References Cited

U.S. PATENT DOCUMENTS 4,676,310 A * 6/1987 Scherbatskoy ..... E21B 23/10 166/113
8,276,674 B2 * 10/2012 Lopez de Cardenas ..... E21B 34/06 166/318

(Continued)

FOREIGN PATENT DOCUMENTS

CN 101952541 A 1/2011
EP 2 484 862 8/2012

(Continued)

OTHER PUBLICATIONS

International Search Report and Written Opinion for PCT/EP2013/069010, dated Dec. 6, 2013, 14 pages.

(Continued)

*Primary Examiner* — Shane Bomar
(74) *Attorney, Agent, or Firm* — Nixon & Vanderhye, P.C.

(57) ABSTRACT

The present invention relates to a downhole system for a well producing hydro-carbon-containing fluid. The downhole system comprises a casing comprising a first casing part and a second casing part, the second casing part having a casing thickness and comprising at least one sleeve having an inner face, and the second casing part being substantially a monobore in that the second casing part has an inner diameter which varies by less than twice the casing thickness; and a drop device for being immersed into the casing having at least one sleeve having an inner face. The drop device comprises a body having a width; a leading end; and a trailing end. The body further comprises an expandable sealing element arranged between the leading end and the trailing end, moving from a first position in which fluid is allowed to pass the device and a second position in which the sealing element abuts the inner face of the sleeve and seals off a first zone in the well from a second zone in the (Continued)

well. Furthermore, the invention relates to a downhole system and a stimulation method.

22 Claims, 12 Drawing Sheets

(51) Int. Cl.

| | |
|---|---|
| ***E21B 33/127*** | (2006.01) |
| ***E21B 43/14*** | (2006.01) |
| ***E21B 43/26*** | (2006.01) |
| ***E21B 33/124*** | (2006.01) |
| ***E21B 34/12*** | (2006.01) |
| *E21B 34/00* | (2006.01) |

(52) U.S. Cl.
CPC ..... *E21B 34/12* (2013.01); *E21B 34/14* (2013.01); *E21B 43/14* (2013.01); *E21B 43/26* (2013.01); *E21B 2034/007* (2013.01)

(56) References Cited

U.S. PATENT DOCUMENTS

| | | | | |
|---|---|---|---|---|
| 9,512,695 | B2 * | 12/2016 | Pabon | E21B 33/10 |
| 9,534,471 | B2 * | 1/2017 | Etzel | E21B 34/14 |
| 2006/0144590 | A1 | 7/2006 | Lopez de Cardenas et al. | |
| 2008/0308271 | A1 * | 12/2008 | Chouzenoux | E21B 47/01 166/250.02 |
| 2009/0159297 | A1 | 6/2009 | Fould et al. | |
| 2011/0284240 | A1 | 11/2011 | Chen et al. | |
| 2012/0085538 | A1 | 4/2012 | Guerrero et al. | |

FOREIGN PATENT DOCUMENTS

| | | | | |
|---|---|---|---|---|
| GB | 2 421 745 | | 7/2006 | |
| WO | WO 2011/134069 | | 11/2011 | |
| WO | WO 2011146866 | A2 * | 11/2011 | E21B 33/12 |

OTHER PUBLICATIONS

International Preliminary Report on Patentability dated Mar. 26, 2015 in International Application No. PCT/EP2013/069010 (9 pages).

Notification of the First Office Action dated Sep. 7, 2016 in Chinese Application No. 201380045704.4, with English translation (13 pages).

* cited by examiner

EXPANDABLE DROP DEVICE

This application is the U.S. national phase of International Application No. PCT/EP2013/069010 filed 13 Sep. 2013, which designated the U.S. and claims priority to EP Patent Application No. 12184463.3, filed 14 Sep. 2012, the entire contents of each of which are hereby incorporated by reference.

FIELD OF THE INVENTION

The present invention relates to a drop device for being immersed into a well having a casing with at least one sleeve having a profile and an inner face. Furthermore, the invention relates to a downhole system and a stimulation method.

BACKGROUND ART

When stimulating production zones in wells, a first ball is dropped into the well and flows with the well fluid until it reaches a ball seat which it cannot pass, causing the ball to seat in the ball seat of a first sleeve. A continuous pumping of fluid into the well then results in a pressure on the ball moving the sleeve from a closed position to an open position. As the sleeve opens, the fluid enters the formation surrounding the well, and the stimulation process can begin. A second production zone is stimulated be dropping a second ball which is larger than the first ball, which flows in the fluid until it reaches a ball seat in another sleeve positioned closer to the top of the well than the first sleeve. The second ball seats in the ball seat of the second sleeve, the sleeve is forced open, and the stimulation process of the second production zone can begin. In this way, multiple balls can be dropped to stimulate multiple sections of the well.

When the stimulation of the production zones has ended, an operation tool is submerged into the well to retrieve the ball seated in the sleeve closest to the surface, e.g. by drilling a hole in the ball. The first operation tool is then retracted from the well again, and the operation tool is, in a second run, submerged into the well to retrieve the next ball. The retrieval process is continued until all the balls have been retrieved, and oil production can be initiated by opening all the sleeves again.

Using this ball dropping process is inexpensive, but also very time-consuming since the balls have to be retrieved one by one. Furthermore, retrieving a round ball rolling in a ball seat can be very difficult, and the retrieval process may therefore fail.

SUMMARY OF THE INVENTION

It is an object of the present invention to wholly or partly overcome the above disadvantages and drawbacks of the prior art. More specifically, it is an object to provide an improved way of stimulating several production zones in a faster and more reliable way than with prior art solutions.

The above objects, together with numerous other objects, advantages, and features, which will become evident from the below description, are accomplished by a solution in accordance with the present invention by a downhole system for a well producing hydrocarbon-containing fluid, comprising:

a casing comprising a first casing part and a second casing part, the second casing part having a casing thickness and comprising at least one sleeve having an inner face, and the second casing part being substantially a monobore in that the second casing part has an inner diameter which varies by less than twice the casing thickness, a drop device for being immersed into the casing having at least one sleeve having an inner face, the drop device comprising:

a body having a width, a leading end, and a trailing end, wherein the body further comprises an expandable sealing element arranged between the leading end and the trailing end, moving from a first position in which fluid is allowed to pass the device and a second position in which the sealing element abuts the inner face of the sleeve and seals off a first zone in the well from a second zone in the well.

By sealing off the first zone from the second zone, acid can be pumped down into the formation without passing the drop device further down the well. In this way, the acid is not wasted, as the rest of the well is sealed off by the sealing element.

The drop device further comprises projectable keys for engaging the profile of the sleeve and opening the sleeve as the drop device is forced downwards when the sealing element abuts the inner face of the sleeve.

In an embodiment, the projectable keys may be projectable radially from the body.

In another embodiment, the drop device may further comprise a detection unit for detecting the sleeve.

Furthermore, the detection unit may comprise a tag identification means for detecting an identification tag, such as a radio frequency identification (RFID) tag, arranged in connection with the sleeve.

Additionally, the detection unit may comprise a casing profiling means, such as a magnetic casing profiling means detecting the magnetic changes in the casing when passing a sleeve or other casing components.

In an embodiment, the width of the body with the sealing element in the first position may be less than an inner diameter of the sleeve.

Also, the body may comprise an activation means for activating the sealing element to move from the first to the second position or from the second to the first position.

In addition, the activation means may be a pump.

Moreover, the activation means may be an electrical motor.

The drop device may further comprise an electrical motor for driving the pump.

Moreover, the drop device may comprise a battery for powering the activation means.

Additionally, the drop device may comprise a turbine for recharging the battery as the device immerses down the well.

In addition, the drop device may comprise a generator driven by the turbine.

Furthermore, the drop device may comprise a timer adapted to activate the sealing element to move from the second position back to the first position after a predetermined time interval.

In an embodiment, the timer may be activated when the sealing element has moved from the first position to the second position.

In another embodiment, the drop device may further comprise an activation sensor adapted to activate the sealing element to move from the second position back to the first position when a condition in the well changes.

Furthermore, the sensor may comprise a pressure sensor adapted to activate the sealing element to move from the second position back to the first position when a pressure in the well changes.

Also, the pressure sensor may activate the sealing element to move when the pressure decreases after reaching a certain pressure, e.g. when the acid stimulation has ended.

During the acid stimulation, the pressure in the well follows a certain pattern, such as a pattern starting with an initial zone pressure and then reaching an increased stimulation pressure followed by a decreased pressure. This pressure pattern is detected by the pressure sensor in the drop device. In most acid stimulation jobs, the pressure increases, then decreases and again drops to a decreased pressure almost equal to the initial zone pressure.

The drop device may further comprise a flow meter adapted to activate the sealing element to move from the second position back to the first position when a flow in the well changes.

Further, the drop device may comprise a connection means arranged at the trailing end.

Hereby, the drop device is adapted to connect itself with a second drop device.

When the first drop device deactivates its sealing element and drops further down the well, the second drop device dumping into the first drop device is connected with the first drop device at the bottom of the well.

Moreover, the drop device may comprise a connection means arranged at the leading end, adapted to connect the drop device with a second drop device.

In an embodiment, the drop device may be autonomous.

By autonomous is meant that the drop device operates without wireline, coiled tubing or drill pipe.

In another embodiment, a wireline may be connected to the drop device.

Furthermore, the sealing element may be inflatable.

Additionally, the sealing element may be an elastomeric compressible element.

The drop device may further comprise a detection sensor for detecting a condition of the well and/or the sleeve.

Moreover, the detection sensor may be a pressure sensor, a temperature sensor and/or a scanning sensor.

Having a sensor enables the drop device to detect if the sleeve has been opened sufficiently for the acid or fracturing fluid to perform an acceptable stimulation job and thus measure the stimulations efficiency. The sensor can subsequently confirm that the sleeve is closed again before the drop device deactivates the sealing element and moves further down the well. The sensor can also measure the pressure in the well during the operation and the pressure difference across the seal initiated by the expanded or inflated sealing element. Furthermore, the sensor can measure the temperature in the well to detect if a water or gas break-through occurs during or after the stimulation. The temperature decreases if the gas content of the fluid entering the well increases after the stimulation process. The temperature increases if the water content of the fluid entering the well after the stimulation process increases.

In an embodiment, the drop device may further comprise a communication unit for loading information from a reservoir sensor.

Moreover, the drop device may further comprise a self-propelling means, such as a turbine or a propeller.

The present invention furthermore relates to a downhole system comprising a well having a plurality of sleeves and the drop device described above, wherein each sleeve has an identification tag, such as an RFID tag.

Furthermore, the well may comprise a casing and a reservoir sensor, and the drop device may comprise a communication unit for loading information from the reservoir sensor.

Moreover, the well may be divided into production zones and comprise a plurality of production sleeves adapted to open in order to start production of fluid through the production sleeve.

In an embodiment, the production sleeve may comprise a screen for filtering the fluid entering through the production sleeve.

The downhole system described above may further comprise annular barriers surrounding the casing, and the downhole system may be expandable to divide the well into production zones.

Furthermore, the present invention relates to a stimulation method comprising the steps of:

- entering a drop device described above into a well to stimulate a first production zone,
- detecting a sleeve in the well,
- activating the sealing element to move from a first position in which flow is allowed to pass the device and a second position in which the sealing element abuts the inner face of the sleeve and seals off a first zone in the well from a second zone in the well,
- pressurising the well filled with fluid, thereby forcing the drop device to move the sleeve from a closed position to an open position,
- letting the fluid out through the open sleeve and into a formation surrounding the well,
- activating the sealing element to move from the second position back to the first position, and
- letting the drop device immerse further into the well.

The stimulation method may further comprise the step of projecting projectable keys and engaging the profile of the sleeve in order to open the sleeve as the drop device is forced downwards when the sealing element abuts the inner face of the sleeve.

Moreover, the stimulation method may comprise the steps of detecting a second sleeve and activating the sealing element to move from the first position to the second position, thereby providing a seal at another position further down the well for stimulation of a second production zone; pressurising the well and opening the second sleeve; letting the fluid out through the second sleeve; activating the sealing element to move from the second position back to the first position; and letting the drop device immerse further into the well.

In addition, the stimulation method may comprise the steps of entering a second drop device into a well when a predetermined amount of time has passed after a pressure decrease during stimulation of the first production zone, using the previous drop device; detecting a second sleeve and activating the sealing element to move from the first position to the second position, thereby providing a seal at another position further down the well for stimulation of a second production zone; pressurising the well and opening the second sleeve; letting the fluid out through the second sleeve and into the second production zone; activating the sealing element to move from the second position back to the first position; and letting the second drop device immerse further into the well.

Moreover, the stimulation method may comprise the steps of abutting the previous drop device with the second drop device, and connecting the two drop devices to each other.

Also, the stimulation method may comprise the steps of entering a fishing tool into the well; connecting the fishing tool to the drop device; and retracting the tool and the drop device from the well.

In an embodiment, several drop devices may be connected before the fishing tool connects to the drop device arranged closest to the top of the well.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
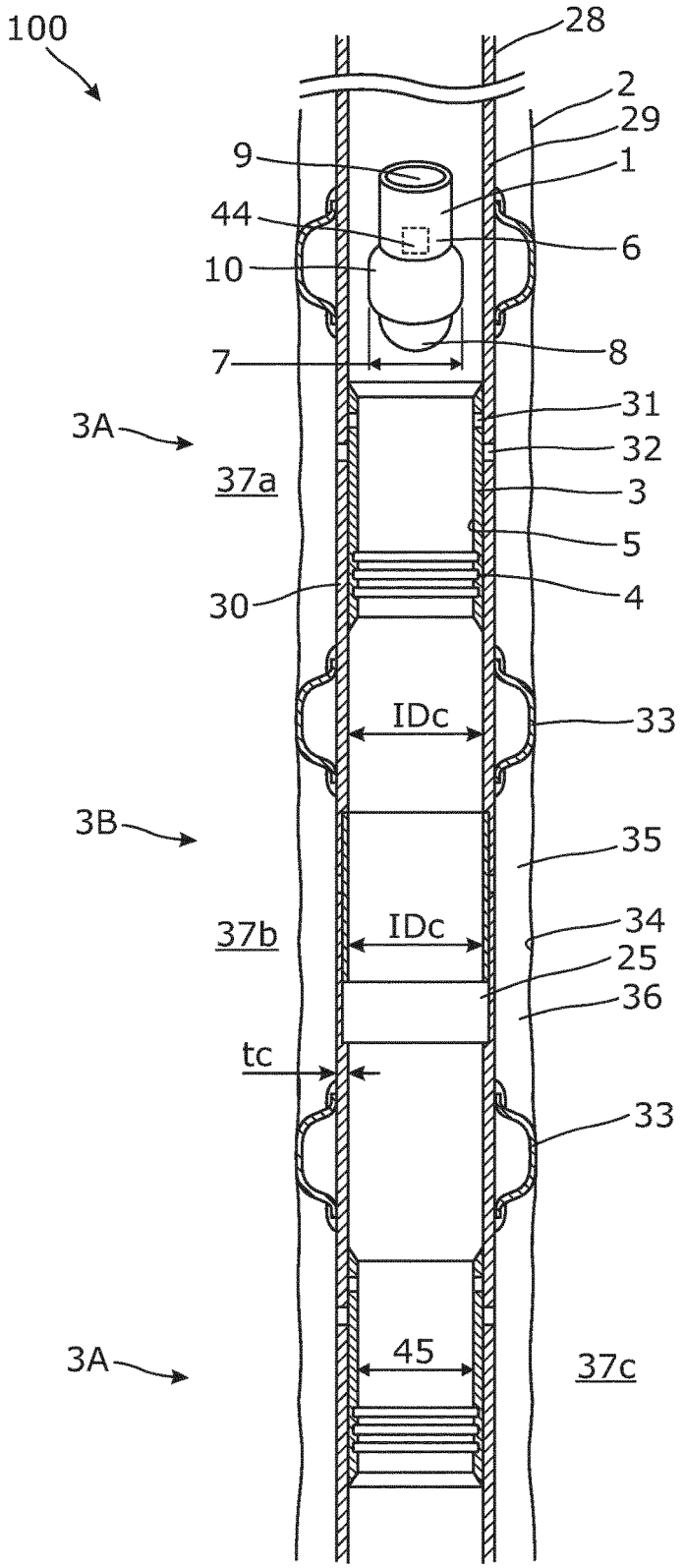
FIG. 1 shows a drop device immersing in a cased well having sleeves to be opened by the drop device.

FIG. 1 shows a downhole system having a casing 30 with several sleeves 3 and a drop device 1 being immersed into the casing 30 of a well 2. The casing 30 has a first casing part 28 and a second casing part 29, and the second casing part comprises the sleeves 3. The second casing part 29 has a casing thickness $t_c$ and is substantially a monobore, meaning that the second casing part has an inner diameter $ID_c$ which varies by less than twice the casing thickness and thus does not hinder hydrocarbon-containing fluid from flowing freely in the casing 30.

In prior art, the sleeves are provided with a projecting flange or seat decreasing the inner diameter by 50 percent. This restriction decreases the flow of hydrocarbon-containing fluid substantially because the sleeves may be opened just by dropping a ball or a similar element seating in the restriction.

Figure 2:
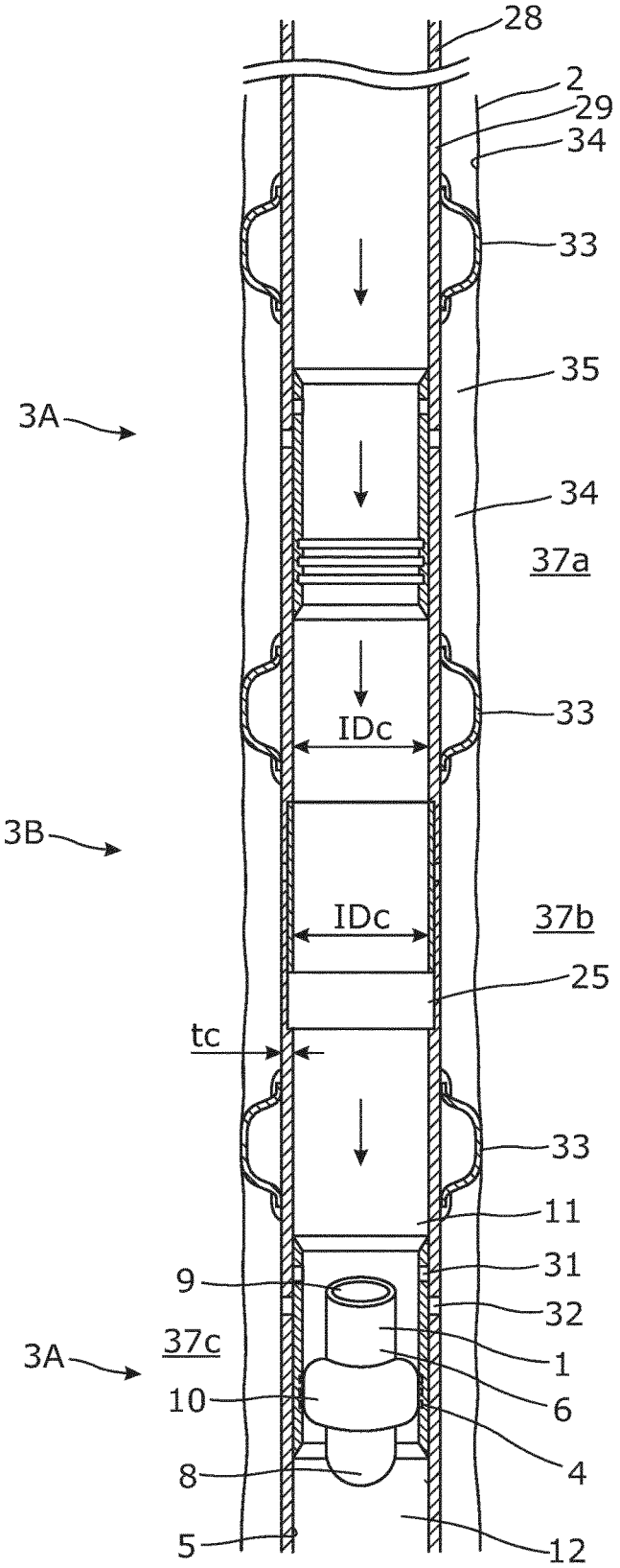
FIG. 2 shows the drop device of FIG. 1 in its first and inflated position opposite the sleeve to be opened.
Figure 3:
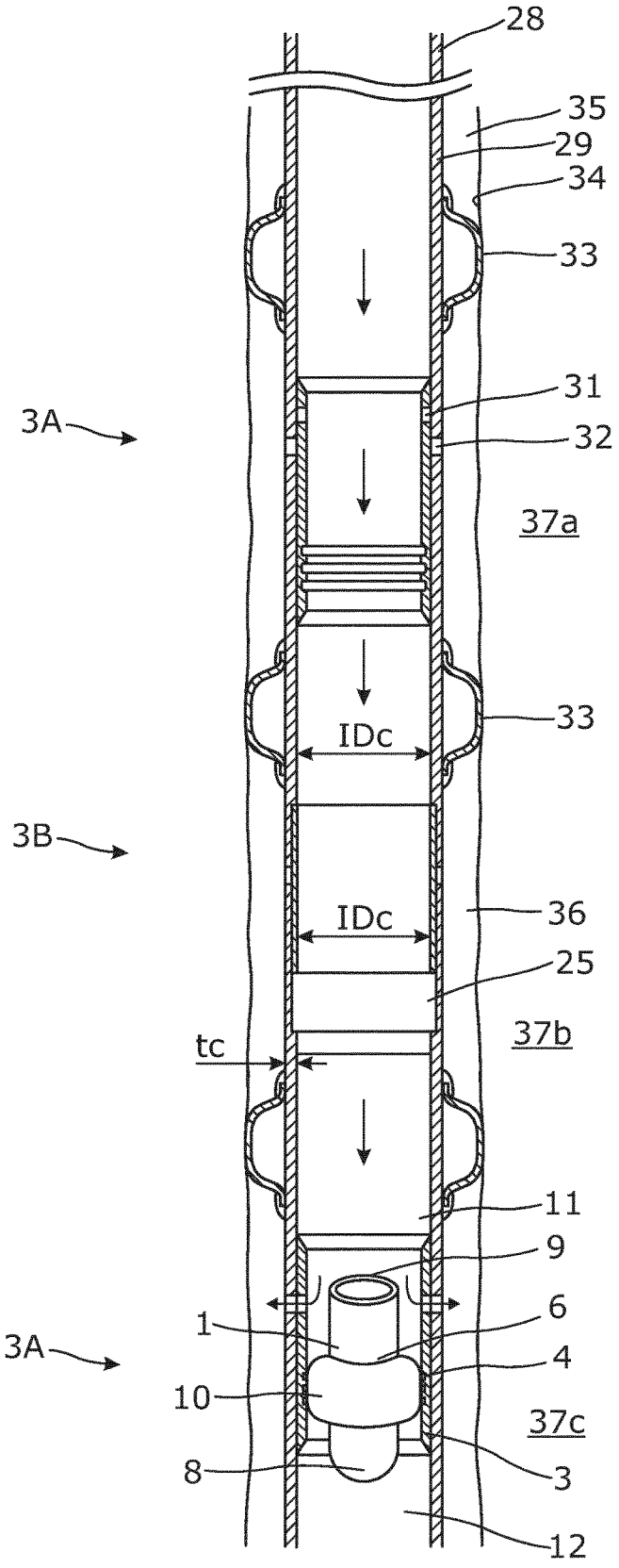
FIG. 3 shows the drop device of FIG. 1 in which the sleeve has been forced open.

The sleeves 3 in FIG. 1 may have a profile 4 on their inner face 5 for a device to engage and open the sleeve so that fluid in the casing can enter the formation surrounding the casing. The sleeves are opened one by one to flush or stimulate the well, e.g. by "fracking the formation", i.e. pumping fluid out through openings 31 in the sleeve and openings 32 in the casing and thus creating fractures in the formation and providing access to hydrocarbon reservoirs in the formation. The well may also be stimulated by pumping acid in through the openings in the casing and the sleeve and dissolving the formation, thereby providing access to the hydrocarbons in the formation. To open a sleeve, the drop device is dropped into the fluid at the top of the well, and the drop device is pumped or falls down the well until it reaches the sleeve which is to be opened. When reaching the sleeve, as shown in FIG. 2, a sealing element 10 surrounding a body 6 of the drop device, arranged between a leading end 8 and a trailing end 9 of the body is moved from a first position to a second, projected position in which the sealing element abuts the inner face of the sleeve. The projected sealing element thus seals off a first zone 11 in the well from a second zone 12 in the well. Subsequently, the fluid pressure in the well is increased so that the drop device is pumped further down the well, opening the sleeve, as shown in FIG. 3.

Having an expandable sealing element 10 sealing the first zone above the drop device from the second zone below the drop device prevents acid from passing the drop device and entering further down the well. This causes all the acid to enter the formation and stimulate the intended production zone opposite the recently opened sleeve, and no acid is wasted on filling up the lower part of the well. In this way, the expandable sealing element 10 allows for the downhole system to be made with sleeves having no restriction, such as the prior art seats or flanges. Hence, the casing part having the sleeves 3 is thus substantially a monobore varying only in the inner diameter $ID_c$ by less than twice the thickness of the casing $t_c$. Monobores are especially wanted in wells having a low reservoir pressure, and these wells therefore become not self-producing easier, thereby requiring the more expensive artificial lift. Thus, by increasing the inner diameter, the wells are self-producing over a longer period of time, which makes it less expensive to extract the oil from the reservoir.

In FIG. 1, the second casing part 29, substantially being monobore, has two types of sleeves; sleeve 3A and sleeve 3B. Sleeves 3A decrease the inner diameter of the second casing part by less than twice the thickness $t_c$ of the casing, while sleeve 3B is another type of sleeve where the sliding part of the sleeve slides in an annular groove 25 in the casing 30.

In addition, the drop device may be used to flush the well on the outside of the casing and thus remove all the drilling mud, etc. When flushing the well, the sleeve furthest away from the top of the well is opened by the drop device, and the fluid is pumped down the inner bore of the casing and back up on the outside of the casing. When the flushing process has ended, the stimulation process can begin, reusing the drop device and sending a second drop device down the well.

Furthermore, due to the drop device, the casing bore is substantially a monobore compared to prior art drop ball solutions with ball seats decreasing the inner diameter of the bore. When completing a well, it is desirable to have the widest inner diameter possible because this makes it much easier to gain access in later operations. Furthermore, it broadens the variety of tools or strings applicable as these operations are not limited to tools or strings which are able to pass the narrow ball seats.

Figure 9:
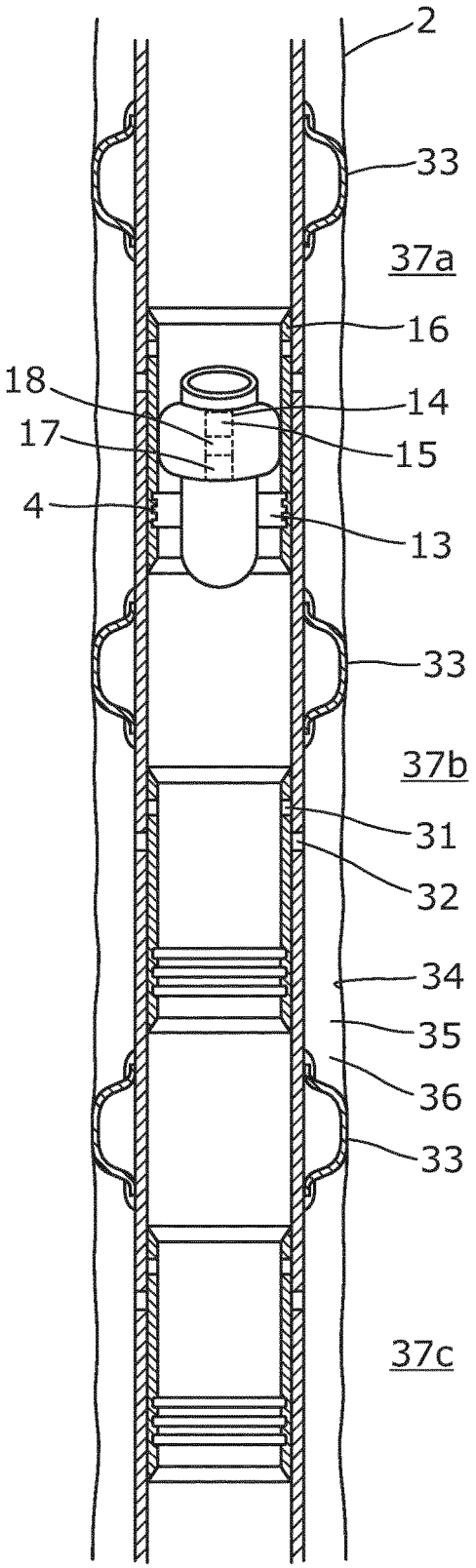
FIG. 9 shows another embodiment of the drop device comprising projectable keys matching a profile in the sleeve to engage the sleeve to force the sleeve open.

While immersing into the well, the drop device projects the sealing element 10 to slow down and abut the inner face of the sleeve. The drop device comprises a detection unit 14 for detecting the sleeve. The detection unit may comprise a tag identification means 15, as shown in FIG. 9, for detecting an identification tag 16, such as an RFID tag, arranged in connection with the sleeve. The identification tag 16 may also be arranged in the casing at a predetermined distance from the sleeve. In another embodiment, the detection unit comprises a casing profiling means 44, as shown in FIG. 1, such as a magnetic casing profiling means detecting magnetic changes in the casing when passing a sleeve or other casing components.

In order to pass a sleeve, the width 7 of the body, as shown in FIG. 1, including the sealing element in the first position, must be less than an inner diameter 45 of the sleeve. When projected, such as expanded or inflated, the width of the body, including the sealing element in the second position, is substantially equal to the inner diameter of the sleeve.

In the downhole system 100 shown in FIG. 1, the casing further comprises annular barriers 33 arranged on an outer face of the casing, expanded to abut the inner face 34 of the borehole 35 and dividing the annulus 36 between the casing and the borehole into production zones 37, 37*a*, 37*b*, 37*c*. In FIG. 3, a third production zone 37*c*, i.e. the production zone furthest away from the top of the well, is being stimulated.

Figure 4:
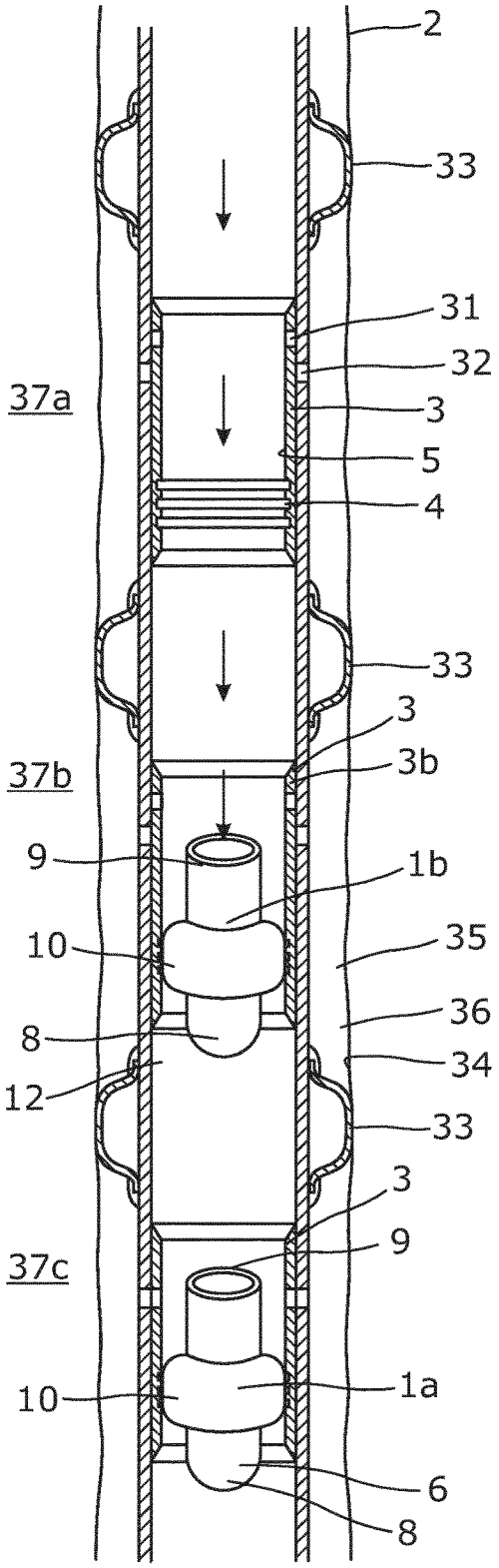
FIG. 4 shows a second drop device in its first and inflated position opposite a second sleeve to be opened.
Figure 5:
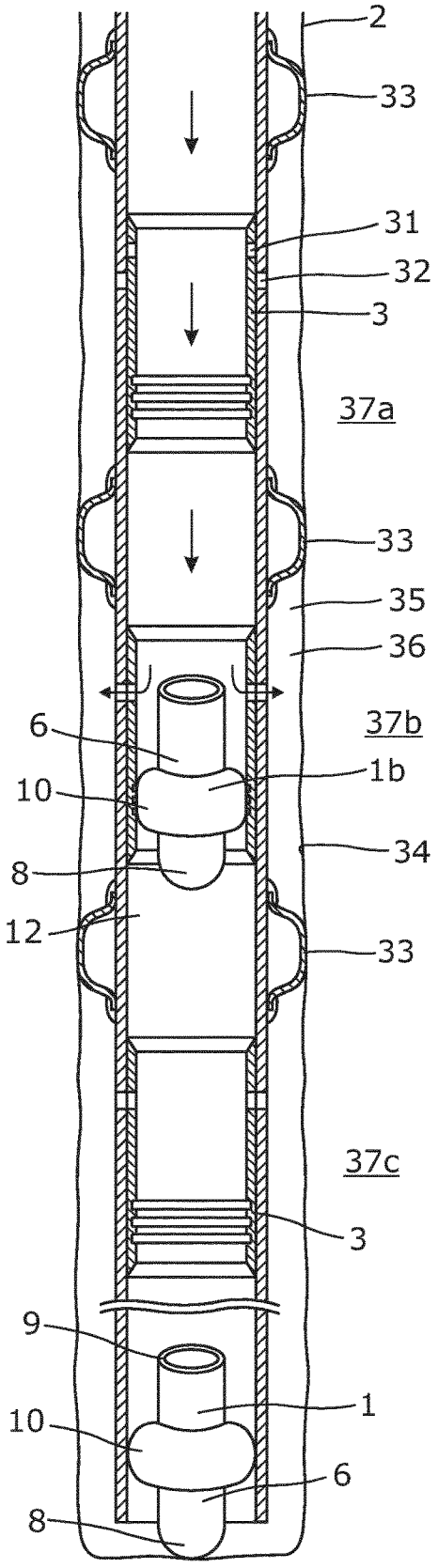
FIG. 5 shows the second drop device of FIG. 4 in which the second sleeve has been forced open.

In FIG. 4, a second drop device 1*b* is dropped into the well while the first drop device 1, 1*a* is still positioned opposite the sleeve in the third production zone 37*c*. The second drop device immerses until it reaches a second sleeve 3*b* arranged above the third production zone 37*c* opposite the second production zone 37*b*. The sealing element 10 of the second drop device is projected to abut and engage the second sleeve, and the drop device is pumped further down the well, opening the second sleeve, as shown in FIG. 5, and fluid is thus allowed to enter into the formation to stimulate the production of hydrocarbons.

Once the sealing element 10 of the second drop device 1*b* engages the inner face of the second sleeve, the second zone 12 below the second drop device 1*b* is isolated and the pressure in the second zone 12 below the second drop device decreases. The first drop device then retracts its sealing element 10 and drops further down the well, as illustrated in FIG. 5. Even though the openings 31 of the sleeve and the openings 32 of the casing are still aligned, enabling the third production zone open to flow, the fluid pumped down the casing to stimulate the second production zone 37*b* does not enter the third production zone, as the sealing element 10 of the second drop device 1*b* hinders fluid from passing this second drop device. Thus, all stimulation fluid is let into the production zone to be stimulated and is not partly wasted on another production zone or on filling up the rest of the well.

Figure 6:
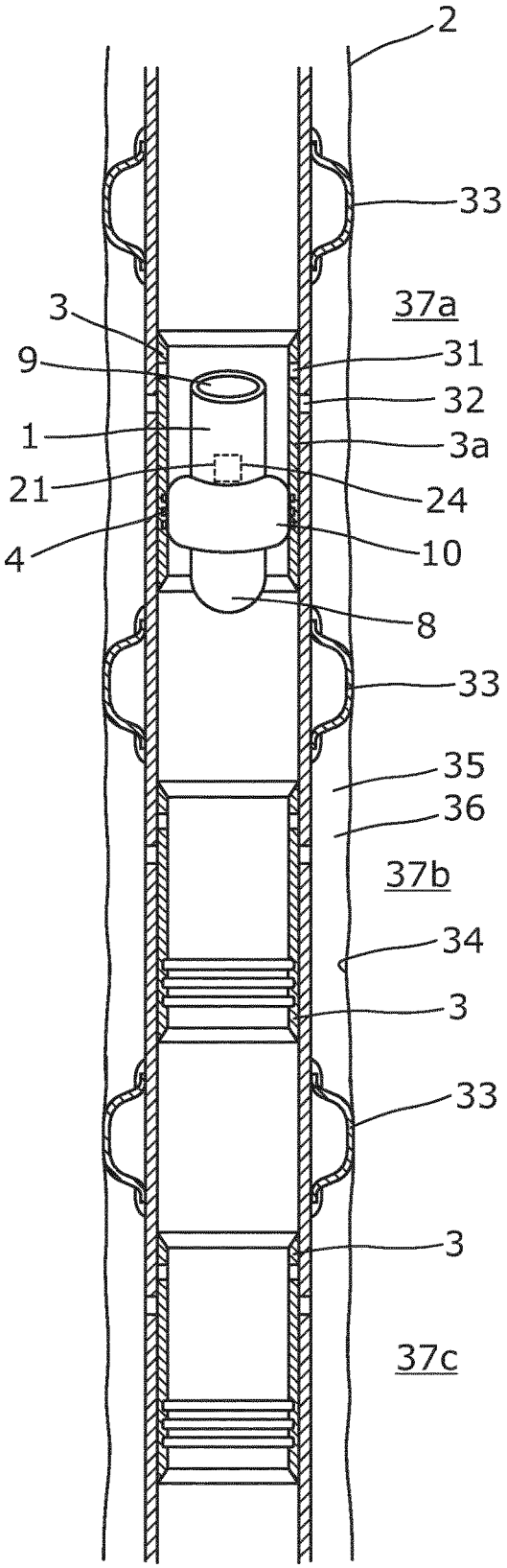
FIG. 6 shows another embodiment of the drop device in its inflated position and opposite a sleeve to be opened.
Figure 7:
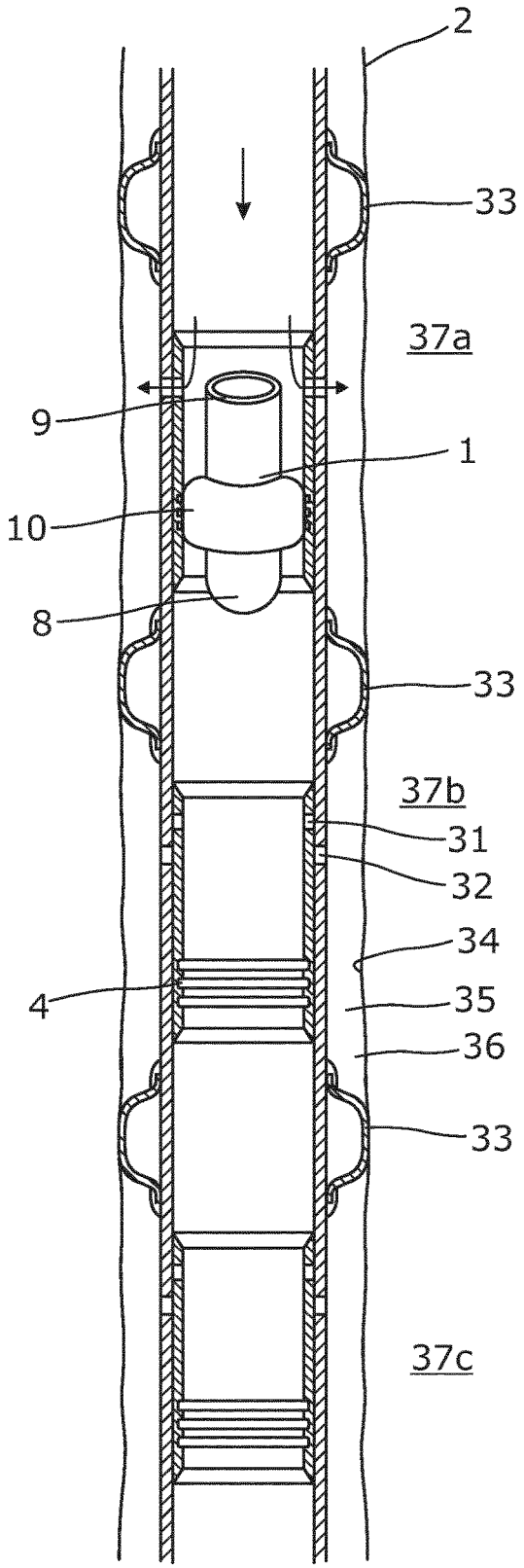
FIG. 7 shows the drop device of FIG. 6 in which the sleeve has been forced open.
Figure 8:
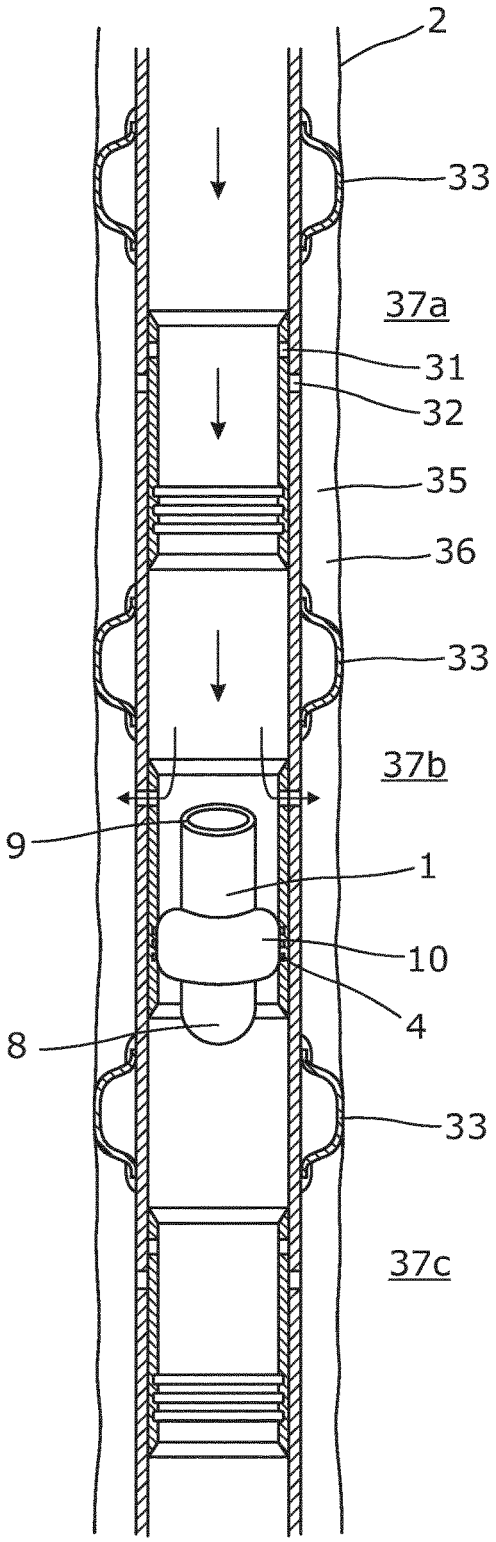
FIG. 8 shows the drop device of FIG. 6 in which the drop device has been deflated and immersed further into the casing to be positioned opposite a second sleeve, at which position the drop device is inflated and the second sleeve is forced open.

In FIGS. 6-8, the drop device is used for opening successive sleeves, and thus, one drop device is used for stimulating several production zones. When reusing the drop device for stimulating several zones, the drop device starts opening a sleeve in the production zone closest to the top of the well and proceeds with the sleeve further down the well until all the production zones have been stimulated. Thus, one drop device is used for performing the stimulation of several or all production zones. In FIG. 6, the drop device flows down the well, and when reaching a position opposite the first sleeve 3*a*, the sealing element 10 is moved from its retracted position to its projected position. By pumping fluid further down the well, the openings in the sleeve and the casing are aligned, and the sleeve is opened, as shown in FIG. 7. Fluid for stimulating the well is then pumped into the formation to stimulate the first production zone 37*a*. When the stimulation process of the first production zone has ended, the sealing element is retracted and the drop device moves further down the well until the drop device reaches the next sleeve, as shown in FIG. 8.

Figure 10:
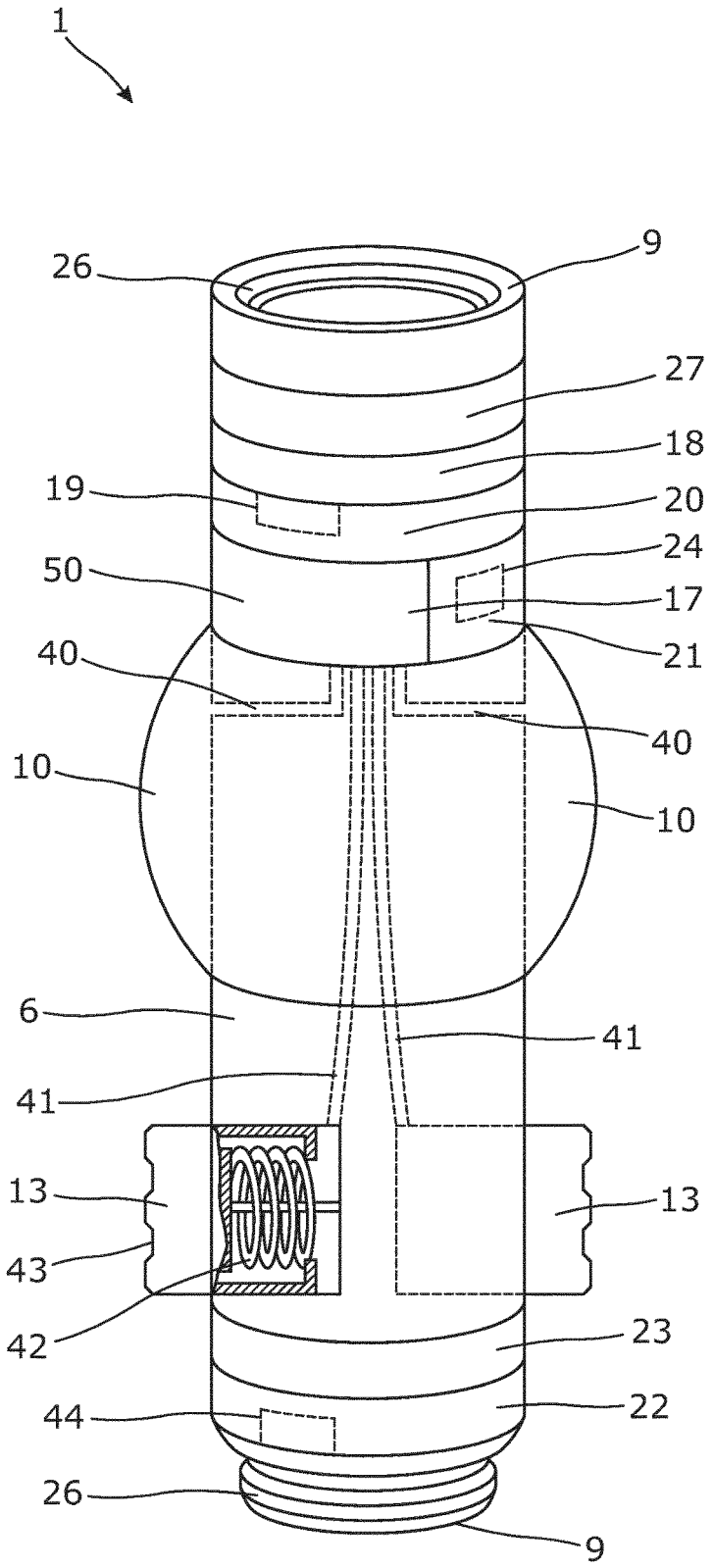
FIG. 10 shows yet another embodiment of the drop device.

In order to be able to retract the sealing element when the stimulation process has ended, the drop device comprises an activation sensor 21, shown in FIG. 10, adapted to activate the sealing element to move from the second position back to the first position when a condition in the well changes. The activation sensor 21 may comprise a pressure sensor 24 adapted to activate the sealing element to move from the second position back to the first position when a pressure in the well changes. During the stimulation job, the pressure decreases in a predetermined pattern, and the pressure sensor thus activates the sealing element to retract when the pressure is measured to have followed the predetermined pattern, e.g. when the pressure decreases after reaching a certain pressure.

During acid stimulation, the pressure in the well follows a certain pattern which is measured by the pressure sensor, the pattern beginning with an initial zone pressure, followed by an increased stimulation pressure which is again followed by a decreased pressure. In most acid stimulation jobs, the pressure decreases, then increases and again drops to a decreased pressure almost equal to the initial zone pressure. "Fracking jobs" follow another pressure pattern which is pre-programmed in the sensor.

In another embodiment, the activation sensor 21 comprises a flow meter adapted to activate the sealing element to move from the second position back to the first position when a flow in the well changes. By measuring the flow in the first zone above the sealing element, the flow of fluid pumped out through the sleeve can be detected so that when the stimulation job has ended, the flow meter detects the change, and the sealing element is then retracted.

The drop device may also comprise a timer 19, as shown in FIG. 10, adapted to activate the sealing element to move from the second position back to the first position after a predetermined time interval. A stimulation job is pre-set to last a certain amount of time, and the timer is thus set to activate retraction of the sealing element according to the maximum duration of the stimulation job. In another embodiment, the timer is reset or activated when the sealing element has moved from the first position to the second position. The timer may further be reset or activated when the pressure sensor or flow meter has detected that the pressure of the flow is below a predetermined value. If the stimulation job is not finalised but only interrupted and subsequently recommenced, the timer is reset again, and the timer ensures that the retraction of the sealing element is not initiated until the stimulation job has ended.

In FIG. 8, the sealing element is projected once again when being opposite the second sleeve which is opposite the second production zone 37*b*, and the sleeve is then opened, and the stimulation can begin. The first sleeve closes when it is no longer retained by the drop device in its open position. The sleeve comprises a retraction spring or a similar retraction solution. When the stimulation job has ended, the drop device continues to the next sleeve until all the intended production zones have been stimulated. After the last stimulation operation, the drop device moves to the end or bottom of the well and is retracted by a fishing tool at the earliest convenience. The retraction of the drop device is not particularly urgent since the drop device does not hinder production or other operations in the well. In order to connect to a fishing tool or a similar operational tool, the drop device comprises a connection means 26 at the trailing end 9, as shown in FIG. 10.

As shown in FIG. 9, the drop device comprises projectable keys 13 for engaging the profile of the sleeve for opening the sleeve as the drop device is forced downwards when the sealing element abuts the inner face of the sleeve. Thus, the projectable keys engage the profile in the sleeve, and the sealing element provides the seal dividing the well into the first and second zone. As can be seen in FIG. 10, the projectable keys are projectable radially from the body. The keys may also be provided on pivotably connected arms or similar key solutions.

The drop device comprises an activation means 17 for activating the sealing element to move to a different position, both from the first position to the second position and back to the first position again.

The sealing element may be inflatable by means of fluid being pumped into the element through fluid channels 40 by the activation means 17 in the form of a pump 50, as shown in FIG. 10. The sealing element may also be an elastomeric, compressible element compressed from one side along the axial extension of the device, resulting in the sealing element bulging outwards to be pressed against the inner face of the sleeve. The axial movement used for compressing the sealing element to project outwards from the body of the drop device is provided by a motor and by a piston driven by a pump. The pump is driven by an electrical motor 20 or directly by the fluid in the casing. The activation means or the motor is powered by a battery 18, resulting in an autonomous drop device, or through a wireline.

The activation means 17 in the form of the pump 50 is also used for projecting the keys by means of fluid channels 41, as shown in FIG. 10, pressing the keys radially outwards and compressing a spring 42 so that the keys are automatically retracted if the pump fails. The keys have a key profile 43 matching the profile 4 of the sleeve.

As shown in FIG. 10, the drop device further comprises a turbine 22 for recharging the battery as the device immerses down the well or for powering the motor. The drop device further comprises a generator 23 driven by the turbine for recharging the battery or powering the motor.

Figure 11:
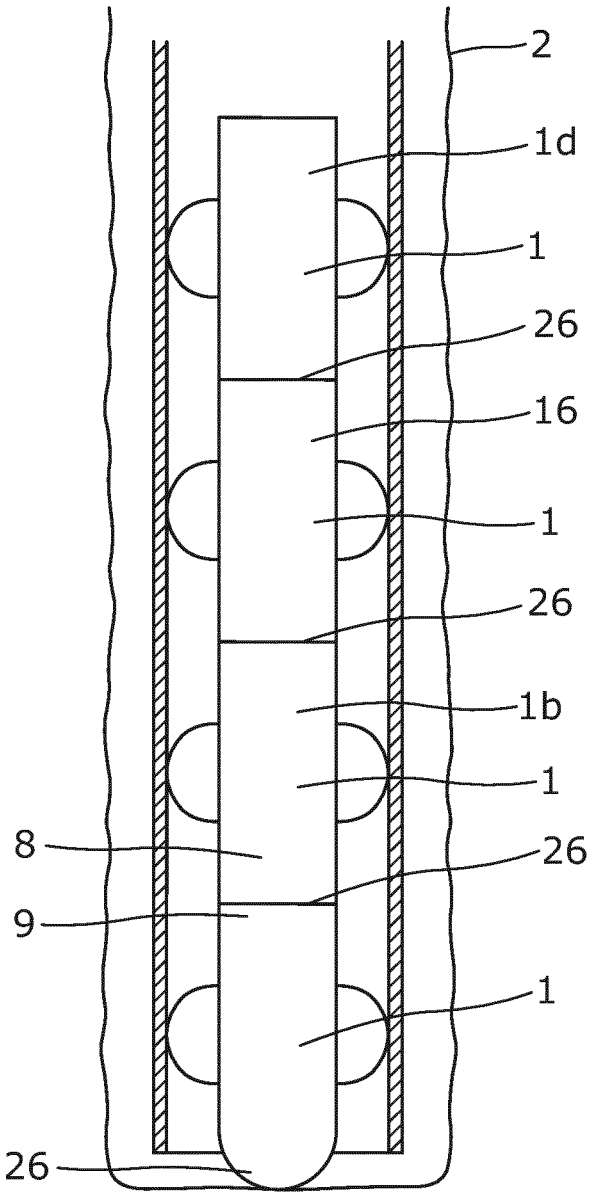
FIG. 11 shows the downhole system having several drop devices being connected at the end of the well.

In FIG. 10, the drop device further comprises a connection means 26 arranged at the leading end, adapted to connect the drop device with a second drop device 1*b*, the second drop device 1*b* with a third drop device 1*c*, and the third drop device with a fourth drop device 1*d*, as shown in FIG. 11. Hereby, the drop device is adapted to connect itself with another drop device. When the first drop device deactivates its sealing element and drops further down the well, the second drop device dumping into the first drop device is connected with the first drop device at the bottom of the well. The sealing elements of the drop device need not be inflated, but if they are inflated, the connection of the drop devices is more successful.

The drop device further comprises a detection sensor 27, as shown in FIG. 10, for detecting a condition of the well and/or the sleeve. The detection sensor may be a pressure sensor, a temperature sensor and/or a scanning sensor. The drop device is thus able to detect if the sleeve has been opened sufficiently for the acid or fracturing fluid to perform an acceptable stimulation job, and it is thus able to measure the stimulations efficiency. The detection sensor can also confirm whether or not the sleeve is closed again before the drop device deactivates the sealing element. The detection sensor can also measure the pressure in the well during the operation to ensure that the stimulation fluid does not enter a leak instead of the recently opened sleeve. Furthermore, the pressure difference across the seal initiated by the expanded or inflated sealing element can be detected, and a proper seal can thus be proven. Moreover, the detection sensor can measure the temperature to detect if a water or gas break-through has occurred as a result of the stimulation process. If the gas content of the fluid entering the well after the stimulation process increases, the temperature will most likely decrease, and if the water content of the fluid entering the well after the stimulation process increases, the temperature will most likely increase.

The downhole system 100 comprises the well having a plurality of sleeves and one or more drop devices, as described above. The sleeves each have a passive identification tag 16, as shown in FIG. 9, which tag is detectable by the drop device so as to identify one sleeve from another sleeve. By having passive tags, such as RFID tags, the sleeves do not need to have a battery or a similar power means which may lose power over time.

Figure 12:
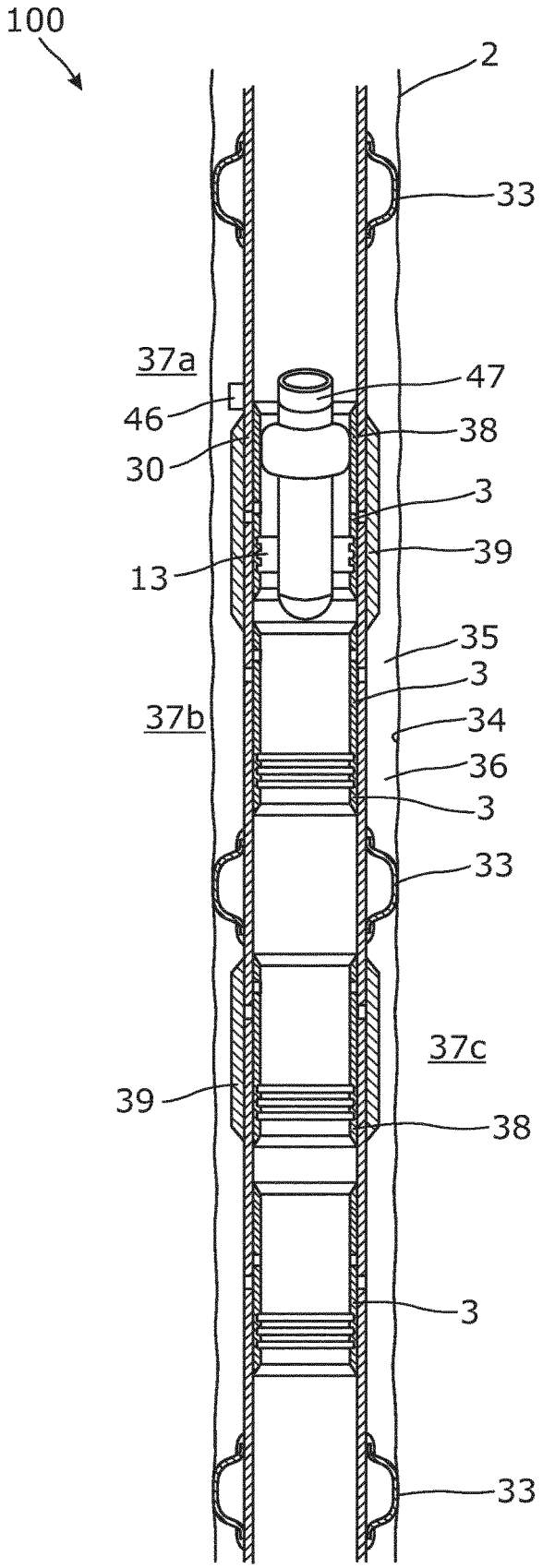
FIG. 12 shows one embodiment of the drop device able to propel itself upwards in the well to open the production sleeves.

In FIG. 12, the completion has several sleeves 3 within one production zone 37. One sleeve has openings 31 which, in the same way as above, are aligned with openings 32 in the casing, enabling a passage of fluid directly into the annulus. The other sleeve is a production sleeve 38 surrounded by a screen 39 so that fluid from the reservoir flows in through the screen 39, past the opening 32 in the casing and in through the openings 31 in the slidable sleeve of the production sleeve 38. The screen thus filtrates the elements, such as scales, proppants, or fragments of sandstone, limestone, etc., from the fluid when the fluid passes through the screen. The drop device is used for opening the sleeves to stimulate the production zones, and subsequently, the drop device propels itself upwards to open the production sleeves. When having opened all the production sleeves, the drop device flows upwards with the fluid and ends at the top of the well.

In order to propel itself upwards, the drop device comprising the aforementioned turbine drives the turbine in the opposite direction and thereby ejects fluid to force itself to the top of the well.

As shown in FIG. 12, the downhole system 100 further comprises a reservoir sensor 46 for sensing the conditions of the well, the formation and the reservoir fluid, and/or for sensing parameters, such as temperature, pressure, etc. When the drop device passes the reservoir sensor 46, a communication unit 47 of the drop device communicates with the reservoir sensor 46 and loads the information of the reservoir condition from the reservoir sensor 46. The information from the reservoir sensor 46 is then downloaded from the communication unit 47 in the drop device when the drop device returns to surface.

Thus, any of the aforementioned drop devices may comprise a communication unit 47 capable of communicating with the reservoir sensor 46 arranged in connection with the casing. The reservoir sensor 46 may be any kind of sensor, such as an electromagnetic sensor, a pressure sensor or a temperature sensor, and may have a communication means for communicating with the communication unit 47 of the drop device. The communication unit 47 of the drop device may comprise an activation means for temporarily activating the reservoir sensor to load the reservoir information from the sensor.

The invention further relates to a stimulation method by which the drop device 1 enters the well 2 for stimulation of a first production zone, as shown in FIG. 1. The sleeve is then detected, and the sealing element is activated to press against the inner face of the sleeve, separating a first zone in the well from a second zone in the well, as shown in FIG. 2 or 6. The well is pressurised, forcing the drop device to move the sleeve from a closed position to an open position, and the fluid is let out through the sleeve, initiating the stimulation process, as shown in FIG. 3 or 7. When the stimulation of this production zone has ended, the sealing element is activated to move from the second position back to the first position, and the drop device immerses further into the well, as shown in FIG. 5 or 11.

In FIG. 8, a second sleeve is detected and the sealing element is activated to press against the inner face of the second sleeve, providing a seal at another position further down the well for stimulation of a second production zone. The well is then again pressurised, thereby opening the second sleeve, and fluid is let out through the second sleeve to stimulate the second production zone. Subsequently, the sealing element is retracted and the drop device immerses further into the well.

The well may be horizontal or vertical. The "up" and "down" used above refer to horizontal as well as vertical wells, "up" being movements towards the top of the well and "down" being movements towards the end of the well.

The stimulation method may further comprise the step of entering a second drop device into a well when a predetermined amount of time has passed from a pressure decrease during stimulation of the first production zone, using the previous drop device. A second sleeve is detected by the second drop device, and the sealing element is activated and moved downwards, thereby opening the second sleeve to let fluid out through the openings 31 in the sleeve and the openings 32 in the casing. When the stimulation has ended, the second drop device immerses further into the well. The second drop device may then abut and connect to a previous drop device. A third and fourth drop device may in the same way connect to the first and second drop devices after they have performed a job or in the event that a job fails. If a drop device fails, it drops to the bottom and connects to another drop device, and a new drop device replacing the failing drop device is dropped into the well.

When all stimulation jobs have been performed successfully, a fishing tool or a similar operational tool can enter the well and fish all drop devices in one run. The fishing tool just needs to connect to the drop device positioned closest to the top of the well to fish all the drop devices.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string etc. used downhole in relation to oil or natural gas production.

In the event that the fishing tool or a similar operational tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole system for a well producing hydrocarbon-containing fluid, comprising:

a casing comprising a first casing part and a second casing part, the second casing part comprising at least one sleeve having an inner face, wherein the at least one sleeve does not include a projecting flange, a drop device for being immersed into the casing, the drop device comprising:

a body having a width, a leading end, and a trailing end, wherein the body further comprises an expandable sealing element arranged between the leading end and the trailing end, moving from a first position in which fluid is allowed to pass the drop device and a second position in which the sealing element abuts the inner face of the sleeve and seals off a first zone in the well from a second zone in the well.

2. A downhole system according to claim 1, wherein the second casing part has a casing thickness, and the second casing part is substantially a monobore in that the second casing part has an inner diameter which varies by less than twice the casing thickness, wherein the monobore does not hinder hydrocarbon-containing fluid from flowing freely in the casing.

3. A downhole system according to claim 1, further comprising projectable keys to engage a profile of the sleeve and opening the sleeve as the drop device is forced downwards when the sealing element abuts the inner face of the sleeve.

4. A downhole system according to claim 1, further comprising a detection unit to detect the sleeve.

5. A downhole system according to claim 4, wherein the detection unit comprises a tag identification device to detect an identification tag arranged in connection with the sleeve.

6. A downhole system according to claim 1, wherein the body comprises an activation device to activate the sealing element to move from the first to the second position or from the second to the first position.

7. A downhole system according to claim 1, further comprising an activation sensor adapted to activate the sealing element to move from the second position back to the first position when a condition in the well changes.

8. A downhole system according to claim 1, further comprising a connection device arranged at the trailing end.

9. A downhole system according to claim 1, further comprising a detection sensor to detect a condition of the well and/or the sleeve.

10. A downhole system according to claim 1, further comprising a communication unit to load information from a reservoir sensor.

11. A downhole system according to claim 1, further comprising a self-propelling mechanism.

12. A downhole system according to claim 1, wherein the casing part comprises a plurality of sleeves, each sleeve having an identification tag.

13. A downhole system according to claim 1, wherein the casing comprises a reservoir sensor, and wherein the drop device comprises a communication unit to load information from the reservoir sensor.

14. A stimulation method comprising:

entering the drop device according to claim 1 into the well to stimulate a first production zone, detecting the sleeve in the well, activating the sealing element to move from the first position in which flow is allowed to pass the drop device and the second position in which the sealing element abuts the inner face of the sleeve and seals off the first zone in the well from the second zone in the well, pressurising the well filled with fluid, thereby forcing the drop device to move the sleeve from a closed position to an open position, letting the fluid out through the open sleeve and into a formation surrounding the well, activating the sealing element to move from the second position back to the first position, and letting the drop device immerse further into the well.

15. A stimulation method according to claim 14, further comprising:

detecting a further sleeve and activating the sealing element to move from the first position to the second position, thereby providing a seal at another position further down the well for stimulation of a second production zone, pressurising the well and opening the further sleeve, letting the fluid out through the further sleeve, activating the sealing element to move from the second position back to the first position, and letting the drop device immerse further into the well.

16. A stimulation method according to claim 14, further comprising:

entering a further drop device into the well when a predetermined amount of time has passed after a pressure decrease during stimulation of the first production zone, using the drop device, detecting a further sleeve and activating a sealing element of the further drop device to move from a first position to a second position, thereby providing a seal at another position further down the well for stimulation of a second production zone, pressurising the well and opening the further sleeve, letting the fluid out through the further sleeve and into the second production zone, activating the sealing element of the further drop device to move from the second position back to the first position, and letting the further drop device immerse further into the well.

17. A stimulation method according to claim 16, further comprising:

abutting the drop device with the further drop device, and connecting the two drop devices to each other.

18. A downhole system according to claim 1, wherein the at least one sleeve is configured so that the at least one sleeve does not substantially decrease the flow of hydrocarbon-containing fluid through the casing.

19. A downhole system according to claim 1, wherein the at least one sleeve includes a profile, wherein the profile extends inwards from the inner face of the at least one sleeve, and wherein the drop device includes at least one projectable key, the shape of the at least one projectable key corresponding to the shape of the profile of the at least one sleeve.

20. A downhole system according to claim 1, wherein the at least one sleeve includes a first opening and the second casing part includes a second opening, wherein the drop device is utilized to align the first opening of the at least one sleeve with the second opening of the second casing part.

21. A downhole system according to claim 1, wherein the at least one sleeve has a tapered leading end and a tapered trailing end.

22. A downhole system according to claim 1, wherein the sealing element abuts the inner face of the sleeve along an innermost radially spaced surface of the sleeve, the innermost radially spaced surface being substantially parallel to a longitudinal axis of the second case part.

* * * * *